US011395564B1

(12) United States Patent
Matias

(10) Patent No.: US 11,395,564 B1
(45) Date of Patent: Jul. 26, 2022

(54) EXPANDING INFANT BATHTUB

(71) Applicant: Natara Matias, Bronx, NY (US)

(72) Inventor: Natara Matias, Bronx, NY (US)

( * ) Notice: Subject to any disclaimer, the term of this patent is extended or adjusted under 35 U.S.C. 154(b) by 0 days.

(21) Appl. No.: 17/352,810

(22) Filed: Jun. 21, 2021

(51) Int. Cl.
*A47K 3/064* (2006.01)

(52) U.S. Cl.
CPC ..... *A47K 3/064* (2013.01)

(58) Field of Classification Search
CPC ..... A47K 3/064
USPC ..... 4/572.1
See application file for complete search history.

(56) References Cited

U.S. PATENT DOCUMENTS 5,439,128 A * 8/1995 Fishman ..... B65D 21/086 206/218
6,507,959 B1 * 1/2003 Sundberg ..... A47K 3/127 4/584
2006/0143819 A1 * 7/2006 Davis ..... A47K 3/024 4/572.1
2013/0198947 A1 * 8/2013 Yeung ..... A47K 3/00 4/585

* cited by examiner

*Primary Examiner* — Huyen D Le

(74) *Attorney, Agent, or Firm* — Michael J. Feigin, Esq.; Feigin and Fridman LLC

(57) ABSTRACT

An expanding bathtub of embodiments of the disclosed technology includes a base, two side walls, and two end walls. Each of the two side walls and the base includes an accordion structure such that the expanding bathtub is expandable between a first, horizontally-compressed configuration and a second, horizontally-expanded configuration. A plurality of sealable and unsealable plugs are located within the side walls, the end walls, and/or the base. Each of the accordion structures, side walls, and end walls is removably connected to various adjacent components of the expanding bathtub.

20 Claims, 18 Drawing Sheets

EXPANDING INFANT BATHTUB

FIELD OF THE DISCLOSED TECHNOLOGY

The disclosed technology relates generally to a infant to toddler bathtub, and more specifically to a bathtub with an expandable structure for growing infants. including multiple water level plugs to control the maximize level of water allowed into structure.

BACKGROUND

The purpose of using a baby bath tub is that they prevent slippage from your baby, and come with a contoured head rest that allows your child's head to remain above water level. Most of these baby bath tubs also contain a newborn sling and a drain plug. avoid dangers of drowning. Also, baby bathtub makes bath time easier for moms who can stand over the kitchen sink rather than sit uncomfortably on the bathroom floor tub side. The kitchen and bathroom sink have to scrubbed before every bath, requiring more prep time. However, as infants mature, they outgrow the normal bath structure before they are large enough for a normal bathtub. Parents may thus be forced to purchase several infant bathtubs for a single infant, which may be unnecessarily expensive.

Thus, there is a need for an infant bathtub which may be resized to accommodate infant growth and have safety features to prevent drowning. This and other problems are solved by embodiments of the disclosed technology, as described below.

SUMMARY OF THE DISCLOSED TECHNOLOGY

An expanding bathtub of embodiments of the disclosed technology includes a base, two end walls, two side walls, and an accordion structure within each of the two side walls. The two side walls are connected at either end to one of the two end walls. Each accordion structure within each of the two side walls includes at least two configurations: a first configuration, in which the accordion structure is collapsed, and a second configuration, in which the accordion structure expanded. The two side walls are water tight at the accordion structure in both configurations and the accordion structure expands to accommodate the growth of the infant and/or a person bath at one time.

The expanding bathtub may further include a plurality of portals on either side of the accordion structure of each respective wall of the two side walls. These portals, in embodiments, are arranged in horizontal rows such that each of the horizontal rows are at different heights relative to one another. In various embodiments, every portal of said portals is sealable with a plug and/or a slidable cover, forming a water-tight seal.

In various embodiments, each accordion structure is repeatedly removable and re-attachable by hand from at least one side of a respective side wall of the two side walls, creating a half tub open on one horizontal side when the accordion structure is removed therefrom.

In embodiments, the accordion structures are expandable and collapsible in a horizontal direction.

The expanding bathtub may further include a lower accordion structure, which forms a continuous and unitary piece with the accordion structure within each of the two side walls, the lower accordion structure being located within the base of the bathtub. The lower accordion structure may be collapsed in the first configuration and expanded in the second configuration. The base may be water-tight at the lower accordion structure in both configurations.

The base may further include at least one portal in the base, which may be sealable with a plug and/or a slidable cover.

The expanding bathtub may further include a pair of raised ridges within the base. Each ridge, in some embodiments, is adjacent to a respective side of, parallel to, the lower accordion structure.

The expanding bathtub, in some embodiments, includes a removably attachable seam between the base and the side walls and/or the end walls. It may further include a removably attachable seam vertically bisecting each of said end walls. Furthermore, in various embodiments, the lower accordion structure is removable, creating a seat comprising a side wall of the two side walls and a portion of the base.

Stated differently, an expanding bathtub of embodiments of the disclosed technology, has a base, two end walls, and two side walls. Each side wall has an accordion structure comprising at least two configurations, wherein the first configuration is with each accordion structure collapsed and the second configuration is with each accordion structure expanded. Each end wall may include two symmetrical portions. Each of these symmetrical portions, in some embodiments, is connected to another symmetrical portion at a first end thereof and to a respective side of a respective side wall at a second end thereof.

The base, in embodiments, includes two substantially identical side portions and a middle portion. The middle portion may include an accordion structure. The middle portion may further have two symmetrical portions. Each of a first end and a second end of each symmetrical portion may be parallel to a ridge of the accordion structure.

In some embodiments, each of the base, the portions thereof, the two end walls, the portions thereof, and the two side walls is removably attachable to the other components.

A method of using the above-described expanding bathtub includes steps of expanding the expanding bathtub into an expanded configuration by way of applying force along a horizontal axis thereof in a first direction, and condensing the expanding bathtub into a condensed configuration by way of applying force along the horizontal axis in a second direction. The second direction is substantially opposite of the first direction.

A separate method of using the above-described expanding bathtub includes steps of removably detaching a symmetrical portion of a first end wall, a contiguous symmetrical portion of the middle portion of the base, and a contiguous symmetrical portion of a second end wall; and then removably attaching the removed symmetrical portion of the first end wall, the contiguous symmetrical portion of the middle portion of the base, and the contiguous symmetrical portion of the second end wall. The method further includes the steps of removably detaching a first end wall, a contiguous side portion of the base, and the middle portion of the base; and then removably attaching the first end wall, the contiguous side portion of the base, and the middle portion of the base.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

An expanding bathtub of embodiments of the disclosed technology includes a base, two side walls, and two end walls. Each of the two side walls and the base includes an accordion structure such that the expanding bathtub is expandable between a first, horizontally-compressed configuration and a second, horizontally-expanded configuration. A plurality of sealable and unsealable plugs are located within the side walls, the end walls, and/or the base. Each of the accordion structures, side walls, and end walls is removably connected to various adjacent components of the expanding bathtub.

Embodiments of the disclosed technology will become more clear in view of the following discussion of the figures.

Figure 1:
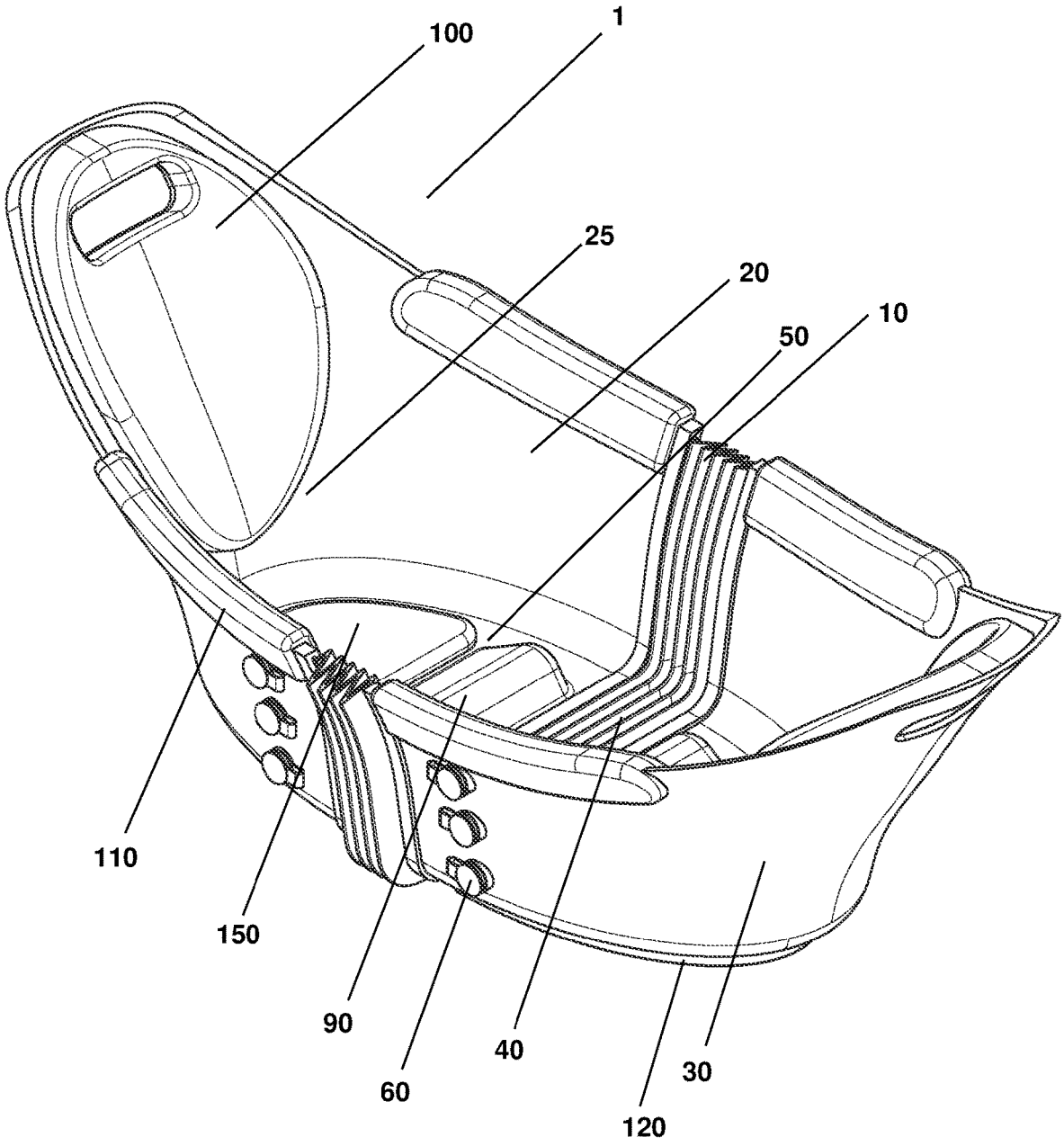
FIG. 1 shows a top and side perspective view of an expanding bathtub of embodiments of the disclosed technology.
Figure 2:
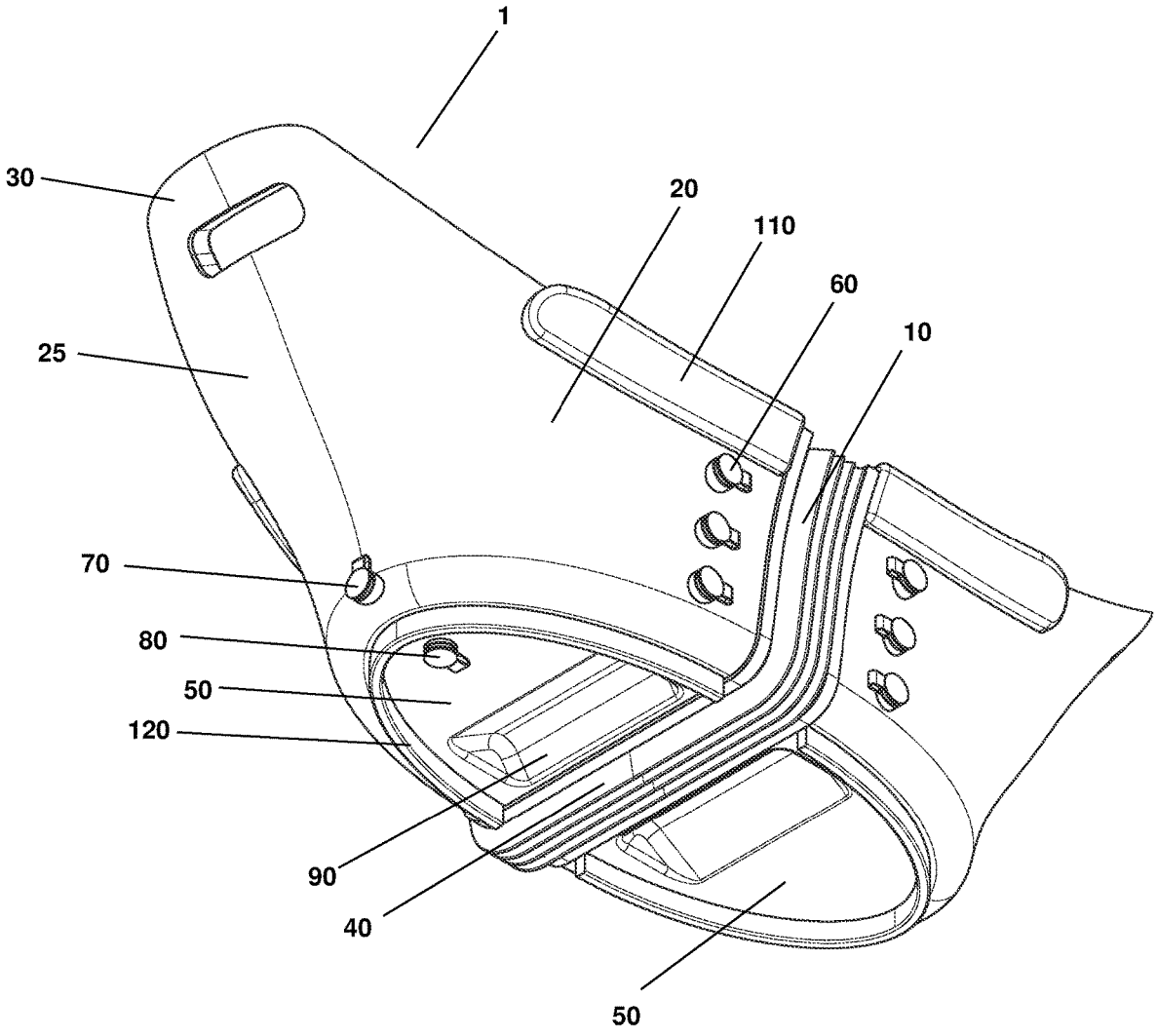
FIG. 2 shows a top and side perspective view of the expanding bathtub of FIG. 1.
Figure 3:
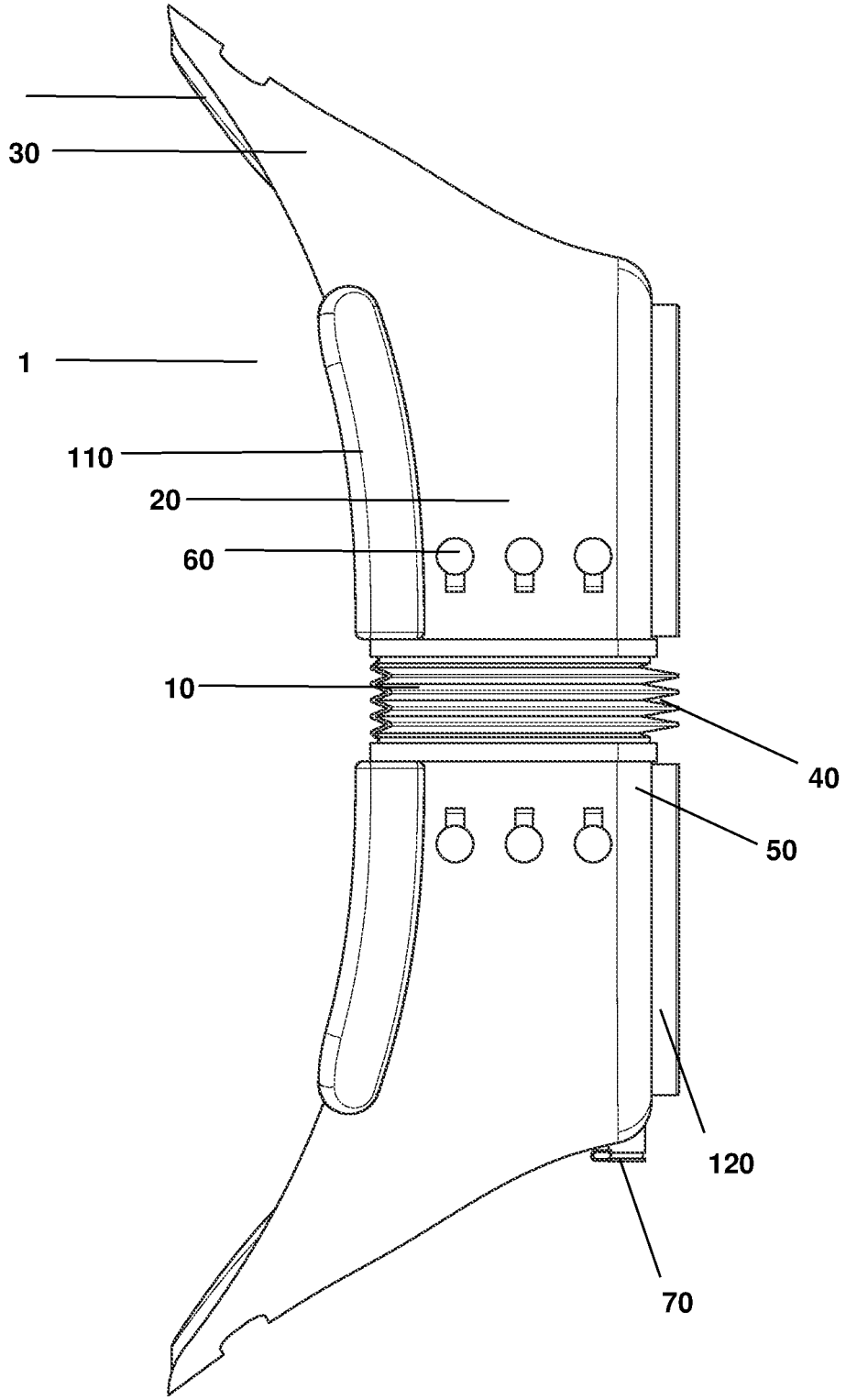
FIG. 3 shows a front elevation view of the expanding bathtub of FIG. 1.

FIG. 1 shows a top and side perspective view of an expanding bathtub of embodiments of the disclosed technology. FIG. 2 shows a top and side perspective view of the expanding bathtub of FIG. 1. FIG. 3 shows a front elevation view of the expanding bathtub of FIG. 1. An expanding bathtub 1 includes two sidewalls 20 with accordion structures 10 connected to a first side thereof and with an endwall 30 connected to a second side thereof. One and/or both of the endwalls 30, in various embodiments, includes a handle. Each accordion structure 10 is opposite the other. Each of the accordion structures 10, sidewalls 20, and endwalls 30 are connected at a bottommost edge thereof to an edge of a base. The base includes a lower accordion structure 40. The lower accordion structure 40 is connected at a first pair of opposite edges thereof to respective edges of two base portions 50, and at a second pair of opposite edges thereof to a lowermost edge of a respective accordion structure 10. In various embodiments, each of the accordion structures 10 and the lower accordion structure 40 form a unitary structure. In other embodiments, Each accordion structure 10 forms a unitary structure with a portion of the lower accordion structure 40.

In other embodiments, the expanding bathtub 1 has two removably attachable sidewalls and a base. Each of the two removably attachable sidewalls includes, in order, a first wall portion 25, an accordion structure 10, and a second wall portion 25. Each of the two removably attachable sidewalls is connected to the other at two outermost, opposite edges thereof. Each of the two removably attachable sidewalls is furthermore connected at a bottommost edge thereof to a portion of the base. Each of the first wall portion 25 and the second wall portion 25 of each respective removably attachable sidewall is attached at a bottommost edge thereof to an edge of a respective base portion 50. Each respective accordion structure 10 of each respective removably attachable sidewall is connected at a bottommost edge thereof to an edge of the lower accordion structure 40.

In various embodiments, the expanding bathtub 1 includes some, all, or none of a plurality of sealable plugs 60, 70, 80. The plugs 60, 70, 80 are sealable, in embodiments, by way of caps, plugs, or any other cover which may be removed and replaced at least 1000 times without being substantially damaged. The plugs 60, 70, 80, when sealed, are substantially water-tight, such that substantially no water passes there-through unless punctured.

The plurality of sealable plugs 60 are located within at least one sidewall 20, and some sealable plugs 60 of the plurality of sealable plugs 60 are located at various vertical heights therein. The sealable plugs 60 are designed such that when the expandable bathtub 1 is at rest on its base for a substantial amount of time (at least 1 hour) and only sealable plugs 60 are unsealed, a water level within the bathtub 1 is equal to or lower than a height of a lowest unsealed plug 60.

The plurality of sealable plugs 70, which includes, in various embodiments, one or more sealable plugs 70, is located within at least one endwall 30. In some embodiments, the sealable plugs 70 of the plurality of sealable plugs 70 are located at various vertical heights within the at least one endwall 30. The sealable plugs 70 are designed such that when the expandable bathtub 1 is at rest on its base for a substantial amount of time (at least 1 hour) and only sealable plugs 70 are unsealed, a water level within the bathtub 1 is equal to or lower than a height of a lowest unsealed plug 70.

The plurality of sealable plugs 80, which includes, in various embodiments, one or more sealable plugs 80, is located within at least one base portion 50. The sealable plugs 80 are designed such that when the expandable bathtub 1 is at rest while flat on its base for a substantial amount of time (at least 1 hour) and sealable plugs 80 are unsealed, substantially no water remains within the bathtub 1.

In the embodiment shown, a lowermost surface of the bathtub 1 includes a lowermost portion and/or portions of the lower accordion structure 40 and/or lower ridges 120 of the base 50 of the bathtub 1.

Figure 4:
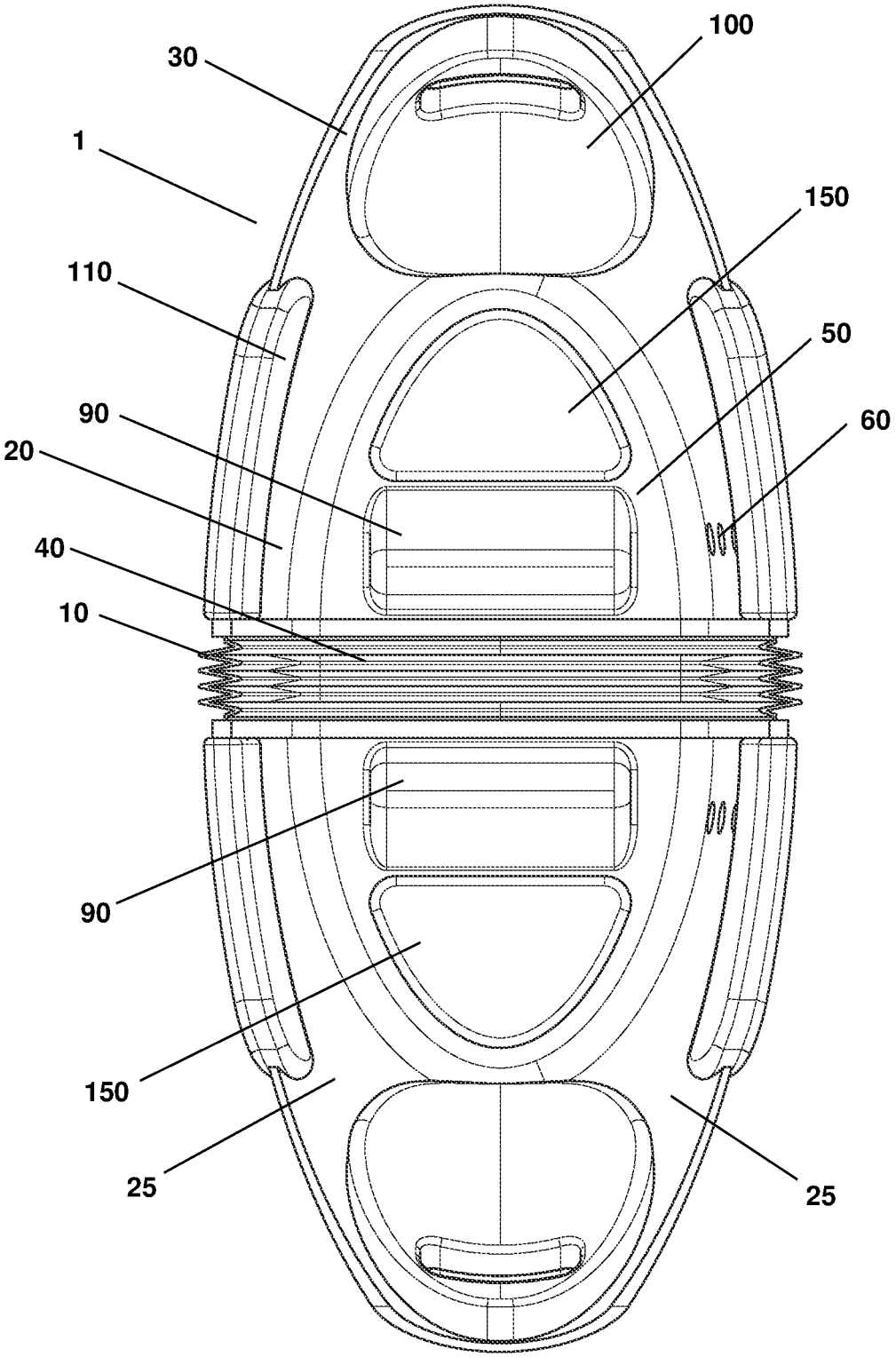
FIG. 4 shows a top plan view of the expanding bathtub of FIG. 1.
Figure 5:
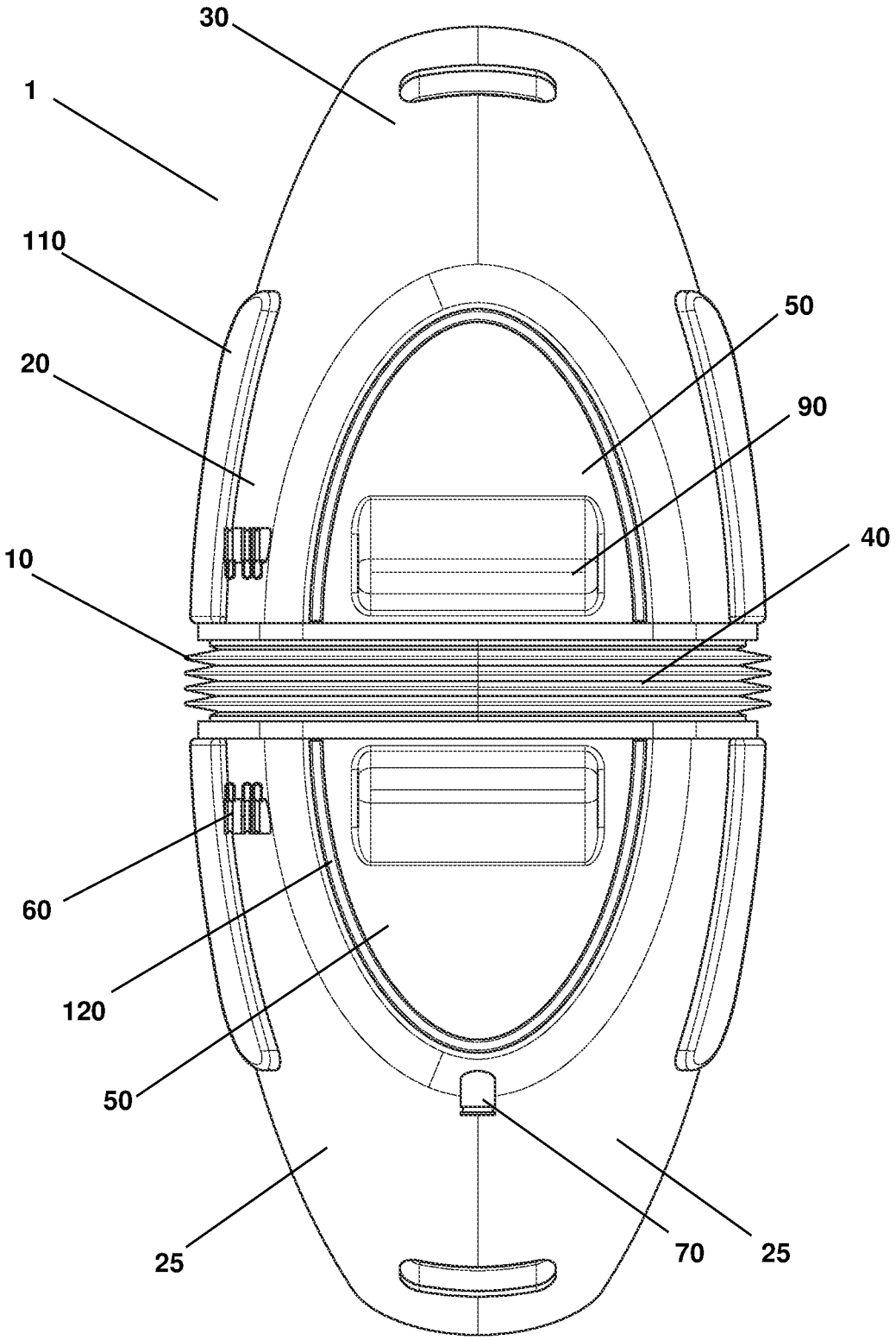
FIG. 5 shows a bottom plan view of the expanding bathtub of FIG. 1.
Figure 6:
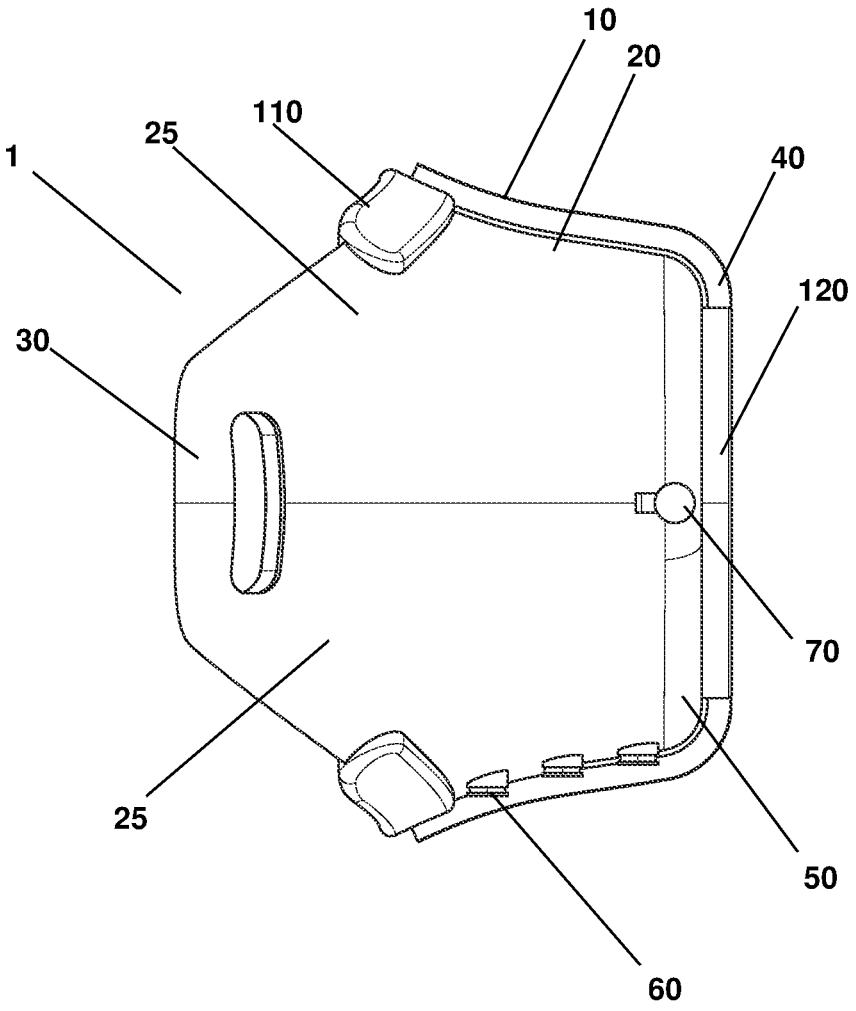
FIG. 6 shows a right elevation view of the expanding bathtub of FIG. 1.

FIG. 4 shows a top plan view of the expanding bathtub of FIG. 1. FIG. 5 shows a bottom plan view of the expanding bathtub of FIG. 1. FIG. 6 shows a right elevation view of the expanding bathtub of FIG. 1. Each respective base portion 50 includes a respective base ridge 90. Each base ridge 90 has an apex portion which is furthest from a floor of the respective base portion 50. In the embodiment shown, each base ridge 90 is hollow. In various other embodiments, each base ridge 90 is solid and/or a bottom-most surface of each base portion 50 is substantially flat. An apex of a base ridge 90, in the embodiment shown, is horizontally closer to an edge of the base ridge 90 which is adjacent to a closest edge of the base accordion 40.

Each respective base portion 50 includes a respective base cushion 150. In the embodiment shown, each base cushion 150 is substantially in a rounded triangular shape, where a "rounded triangular shape" is defined as "a shape with three substantially straight edges connected at ends thereof by rounded corners." Furthermore, in the embodiment shown, a longest edge of each base cushion 150 is substantially of a same length as a most-adjacent edge of a closest base ridge 90. In other embodiments, each base cushion 150 is of substantially any size and/or placement which fits onto a respective base portion 50 while leaving a respective base ridge 90 uncovered.

In the embodiment shown, each horizontal cross-section of the bathtub 1 is substantially in a shape of an oval, where "oval" is defined as "having a rounded and slightly elongated outline or shape." In other embodiments, each horizontal cross-section of the bathtub 1 is in any substantially rounded shape.

Figure 7:
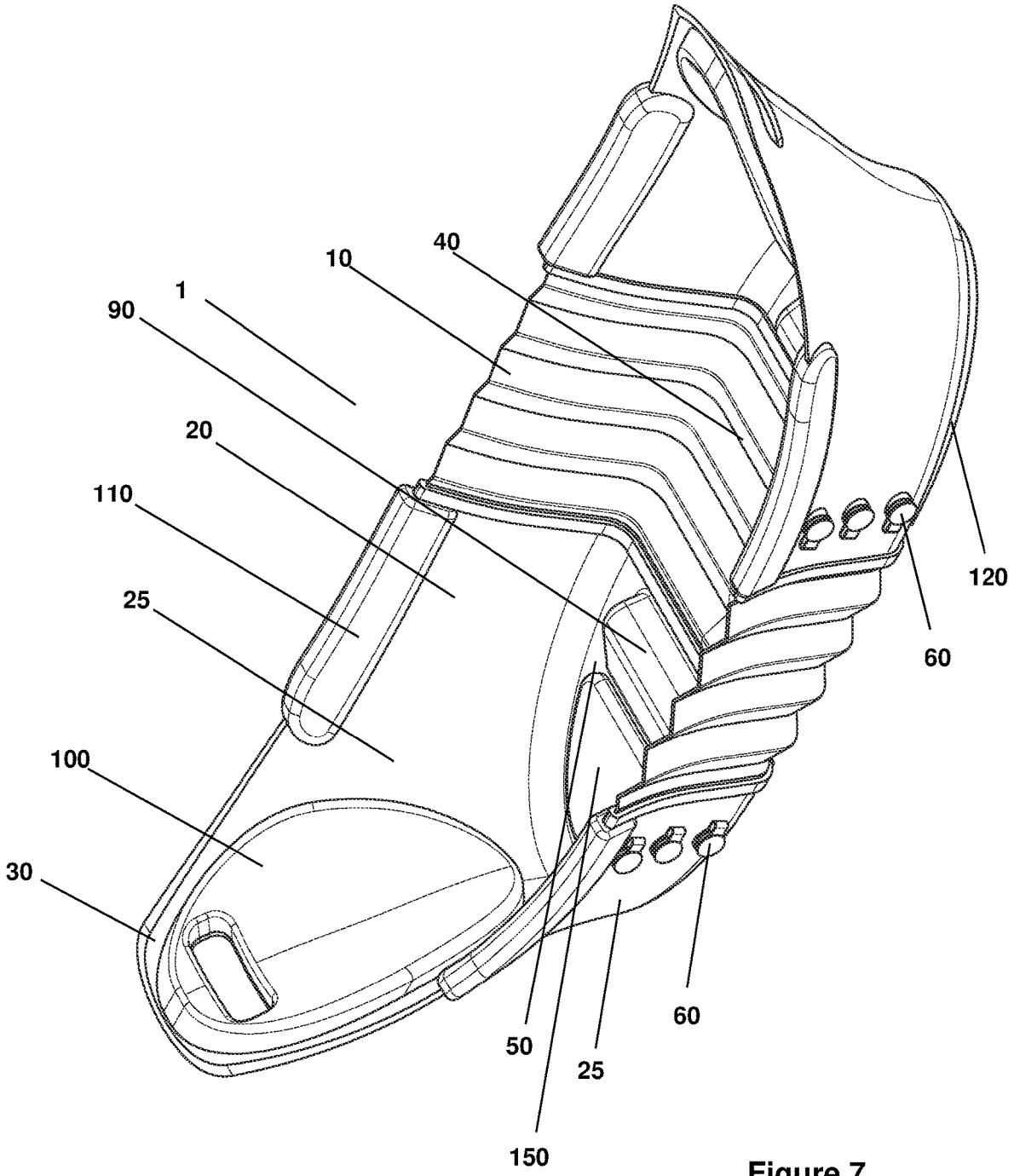
FIG. 7 shows a top and side perspective view of the expanding bathtub of FIG. 1 in an expanded configuration.
Figure 8:
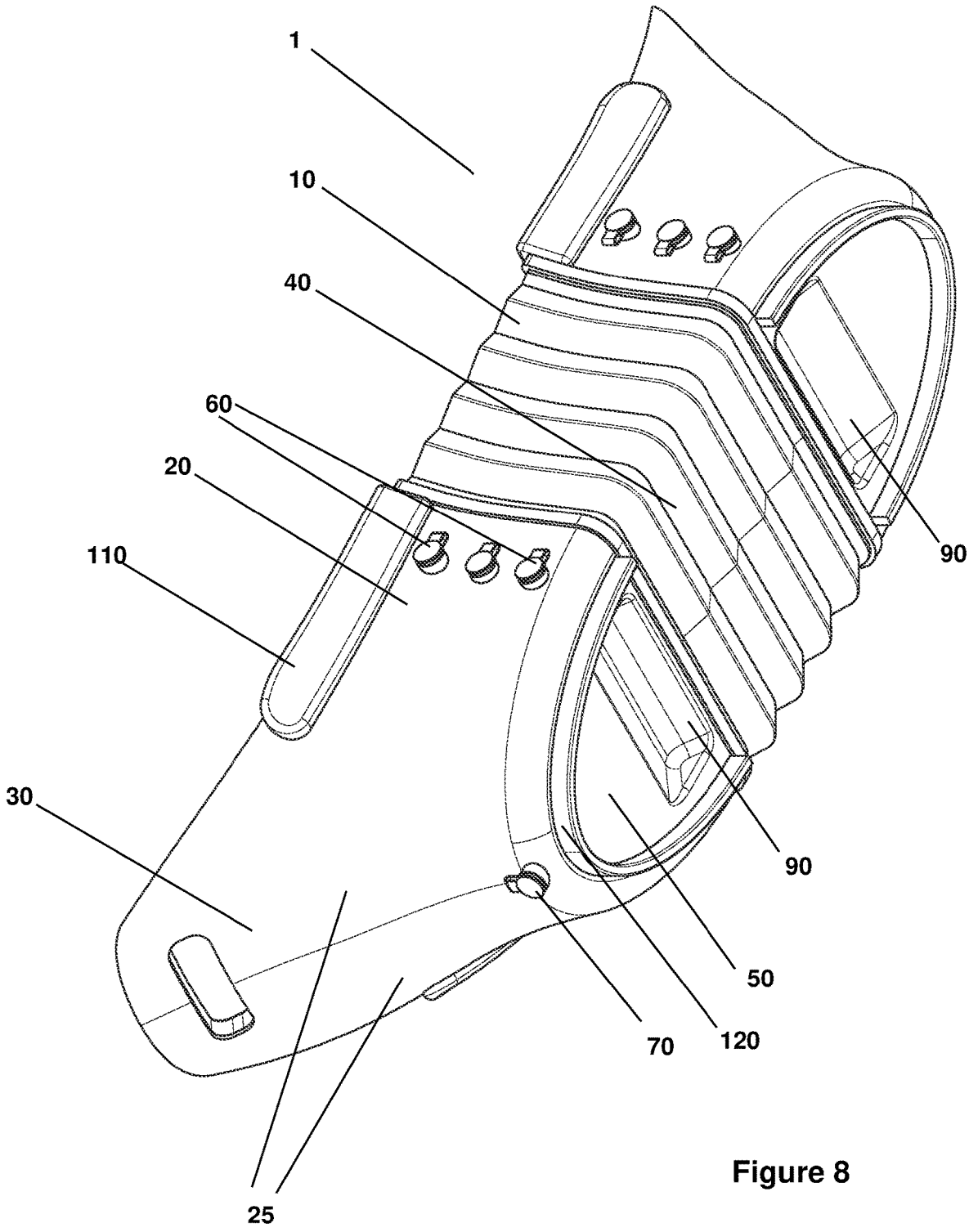
FIG. 8 shows a bottom and side perspective view of the expanding bathtub of FIG. 1 in an expanded configuration.
Figure 9:
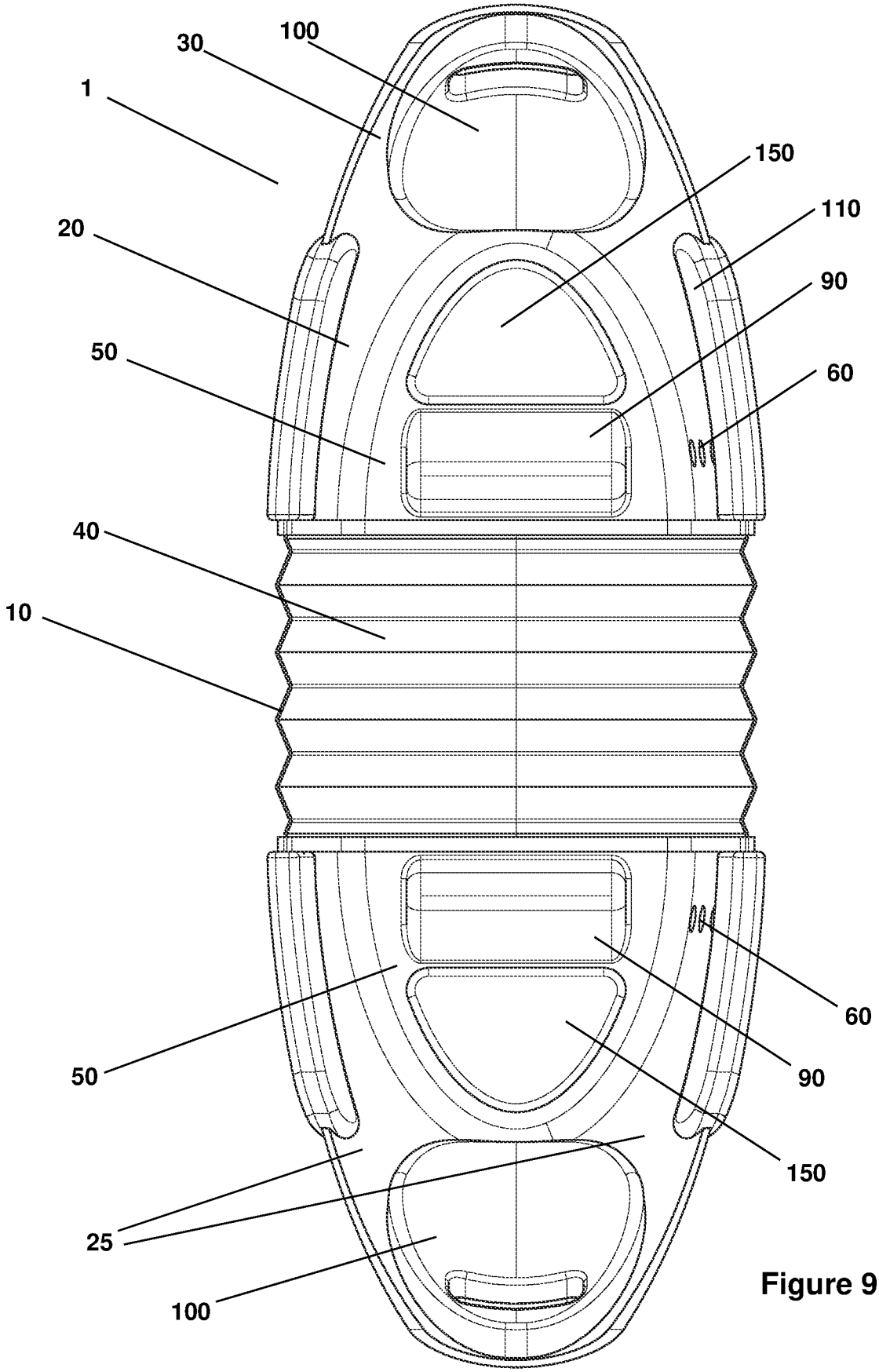
FIG. 9 shows a top plan view of the expanding bathtub of FIG. 1 in an expanded configuration.
Figure 10:
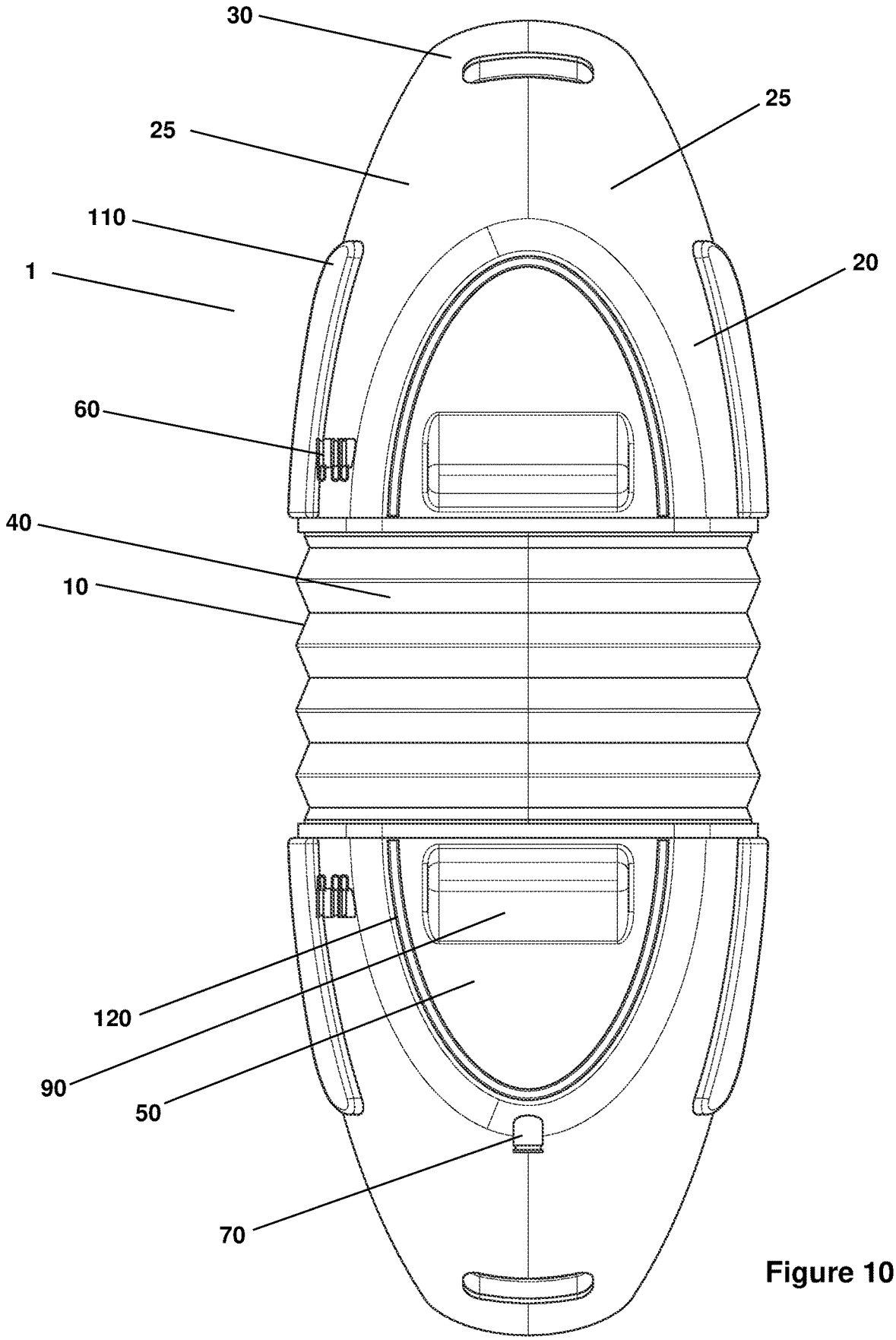
FIG. 10 shows a bottom plan view of the expanding bathtub of FIG. 1 in an expanded configuration.
Figure 11:
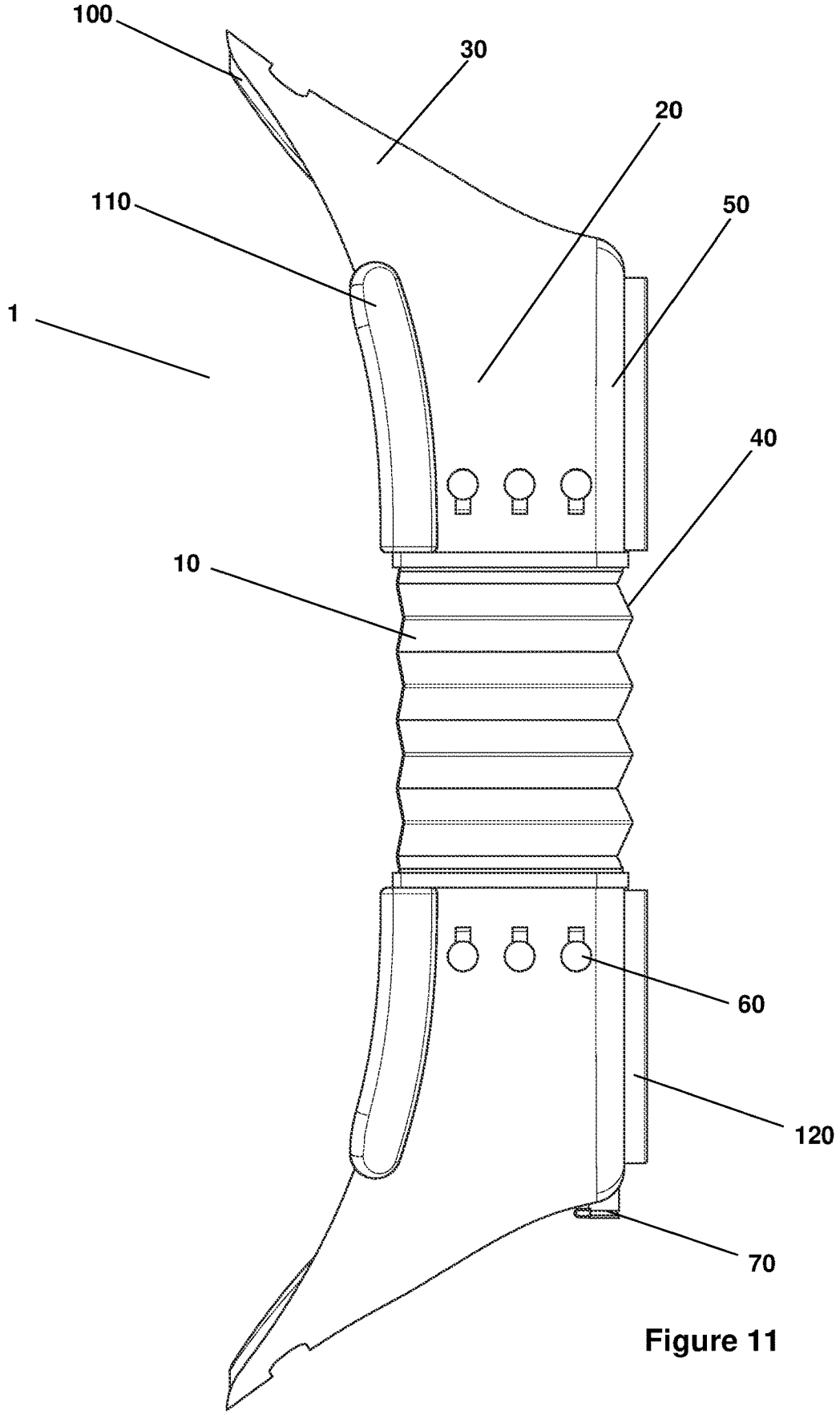
FIG. 11 shows a front elevation view of the expanding bathtub of FIG. 1 in an expanded configuration.

FIG. 7 shows a top and side perspective view of the expanding bathtub of FIG. 1 in an expanded configuration. FIG. 8 shows a bottom and side perspective view of the expanding bathtub of FIG. 1 in an expanded configuration. FIG. 9 shows a top plan view of the expanding bathtub of FIG. 1 in an expanded configuration. FIG. 10 shows a bottom plan view of the expanding bathtub of FIG. 1 in an expanded configuration. FIG. 11 shows a front elevation view of the expanding bathtub of FIG. 1 in an expanded configuration.

Each of the side accordions 10 and the base accordion 40 are expandable in a horizontal direction, where "expandable" is defined as "deformable in a horizontal direction, such that the accordion can be restored to its compressed structure."

The lower ridge 120 of the expanding bathtub 1 includes two portions, substantially corresponding to a respective base portion 50. Thus, in the embodiment shown, in the expanded configuration, the lower ridge 120 is divided into a right-side lower ridge and a left-side lower ridge.

Each end wall 30, in the embodiment shown, includes an end cushion 100. Each end cushion is rounded, but in other embodiments, each end cushion may be in any shape.

Each side wall 20 includes two side cushions 110 on a top edge thereof. Each side cushion 110 is on a portion of the top edge of the side wall 20 most-adjacent to a respective side of a respective side accordion 10. Each side cushion 110 is on a portion of the top side, inner side, and outer side of a respective side wall 20.

Each base cushion 150, end cushion 100, and side cushion 110 may be removably attachable and detachable.

Figure 12:
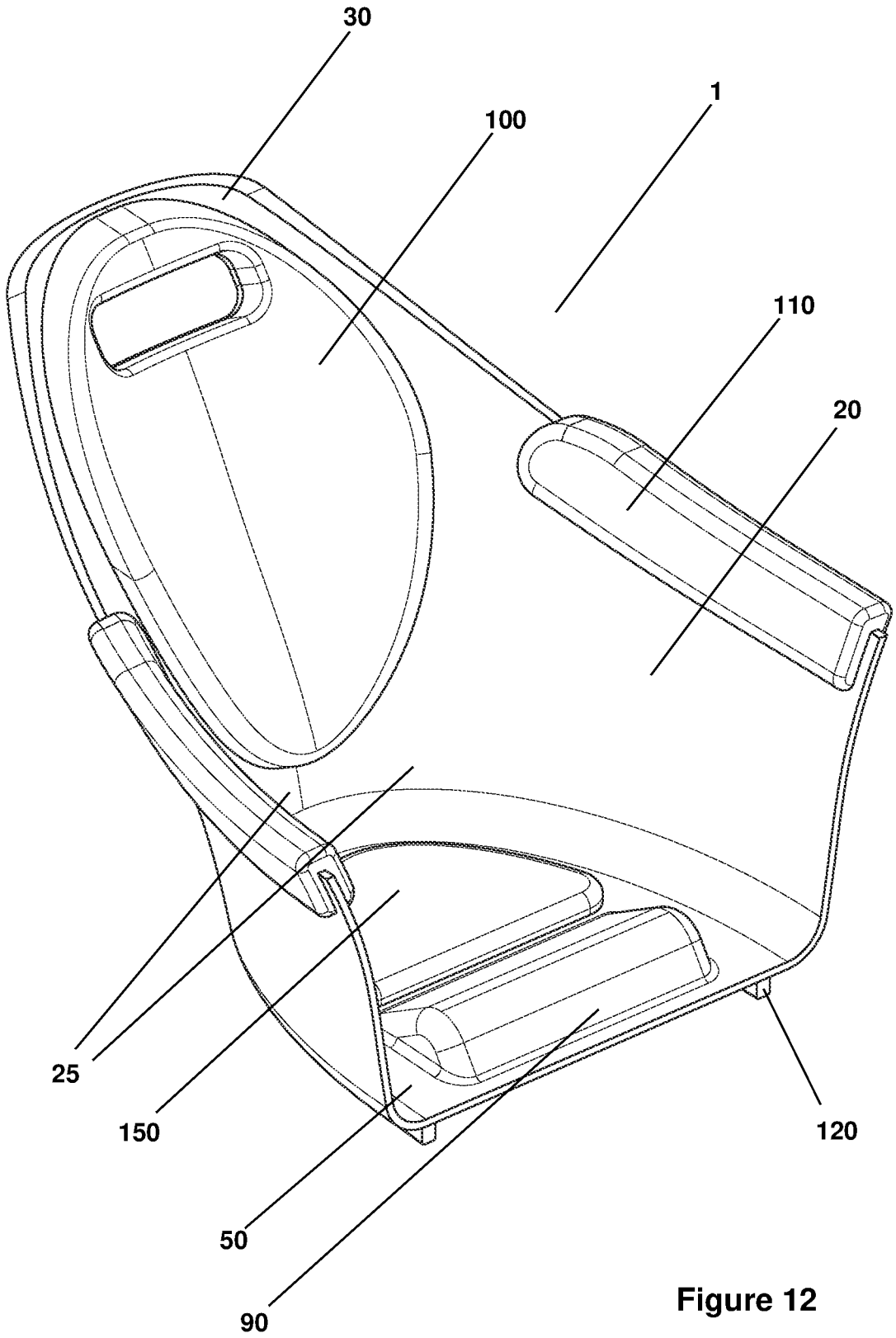
FIG. 12 shows a top and side perspective view of the expanding bathtub of FIG. 1 in a detached configuration.
Figure 13:
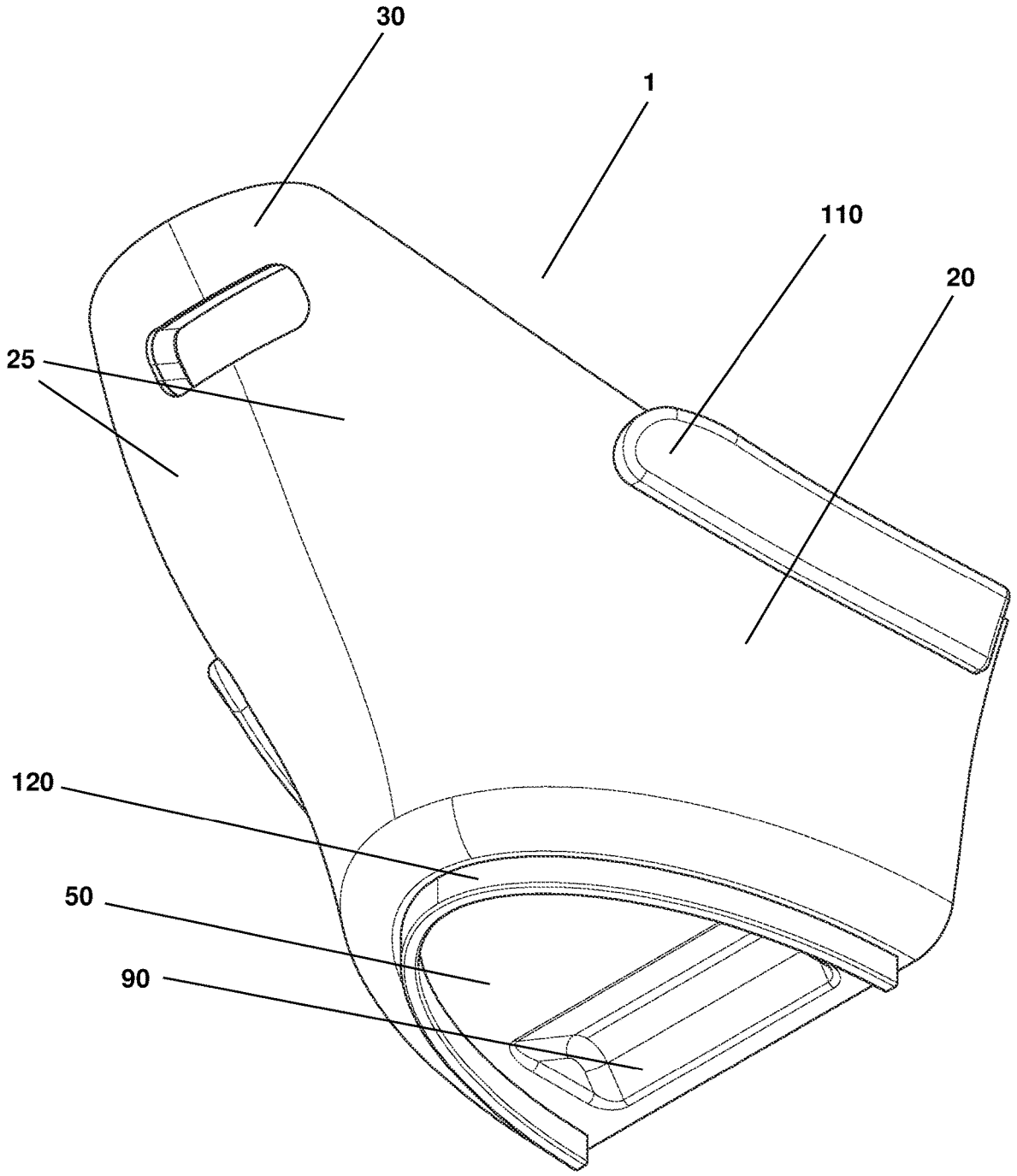
FIG. 13 shows a bottom and side perspective view of the expanding bathtub of FIG. 1 in a detached configuration.
Figure 14:
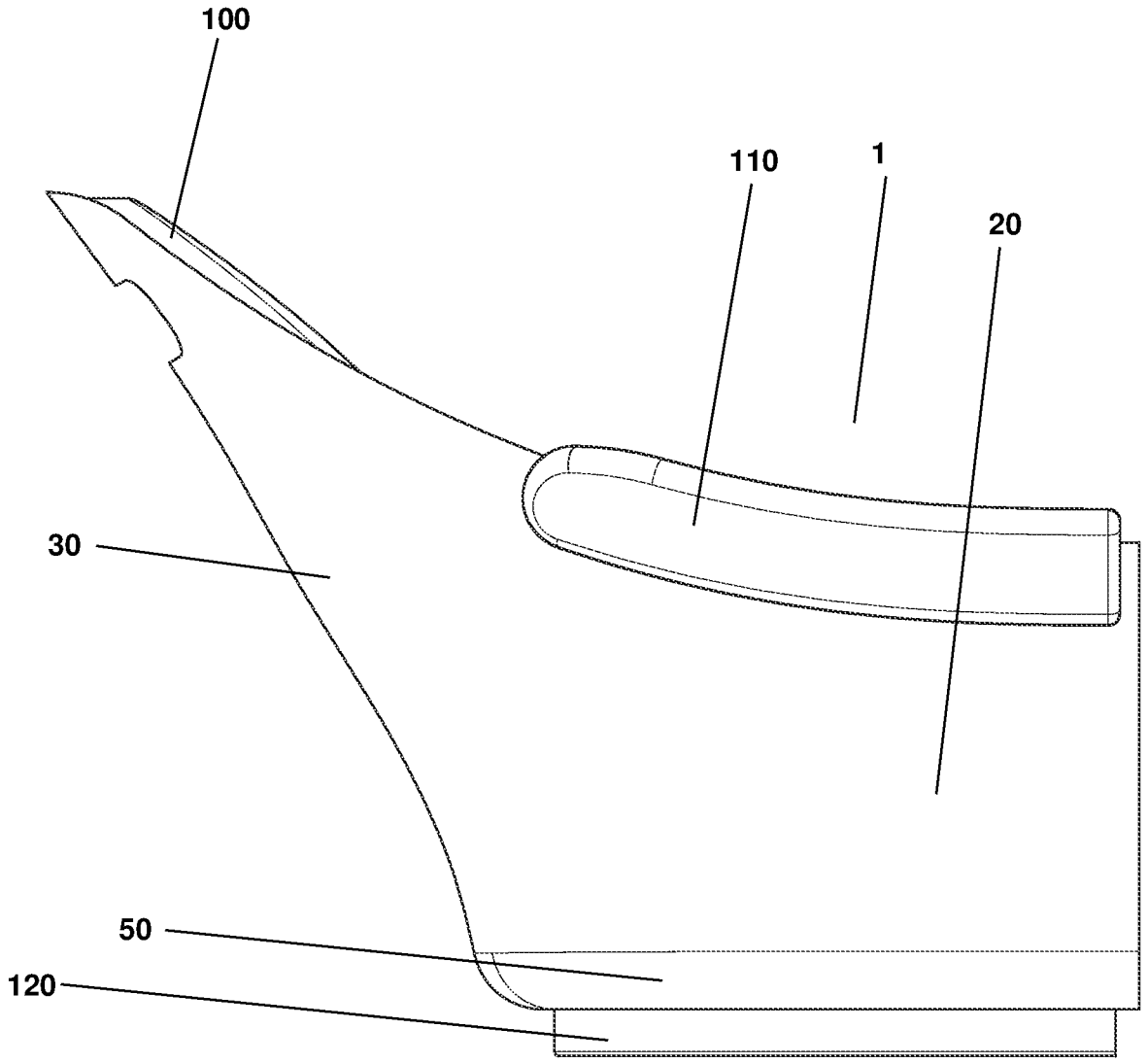
FIG. 14 shows a front elevation view of the expanding bathtub of FIG. 1 in a detached configuration.

FIG. 12 shows a top and side perspective view of the expanding bathtub of FIG. 1 in a detached configuration. FIG. 13 shows a bottom and side perspective view of the expanding bathtub of FIG. 1 in a detached configuration. FIG. 14 shows a front elevation view of the expanding bathtub of FIG. 1 in a detached configuration.

A combination of two most-adjacent portions 25 of two opposite sidewalls 20, an end wall 30 located there-between, and a base portion 50 located there-between are removable, where "removable" is defined as "capable of being detached and reattached in a same place at least 1000 times without being substantially deformed." These portions may thus be removed to form a seat configuration. The bathtub 1 can thus be separated into at least three components: A first portion in a seat configuration (from a horizontally-rightward side of the bathtub 1), a second portion in a seat configuration (from a horizontally-leftward side of the bathtub 1), and a middle portion (including the two side accordions 10 and the base accordion 40).

Each end wall 30 of each respective seat configuration, in the embodiment shown, includes a cutout handle. Each end cushion 100 further includes a cutout handle in a corresponding location. In other embodiments, one and/or both end wall(s) 30 includes a handle, whether cutout or extruded.

Figure 15:
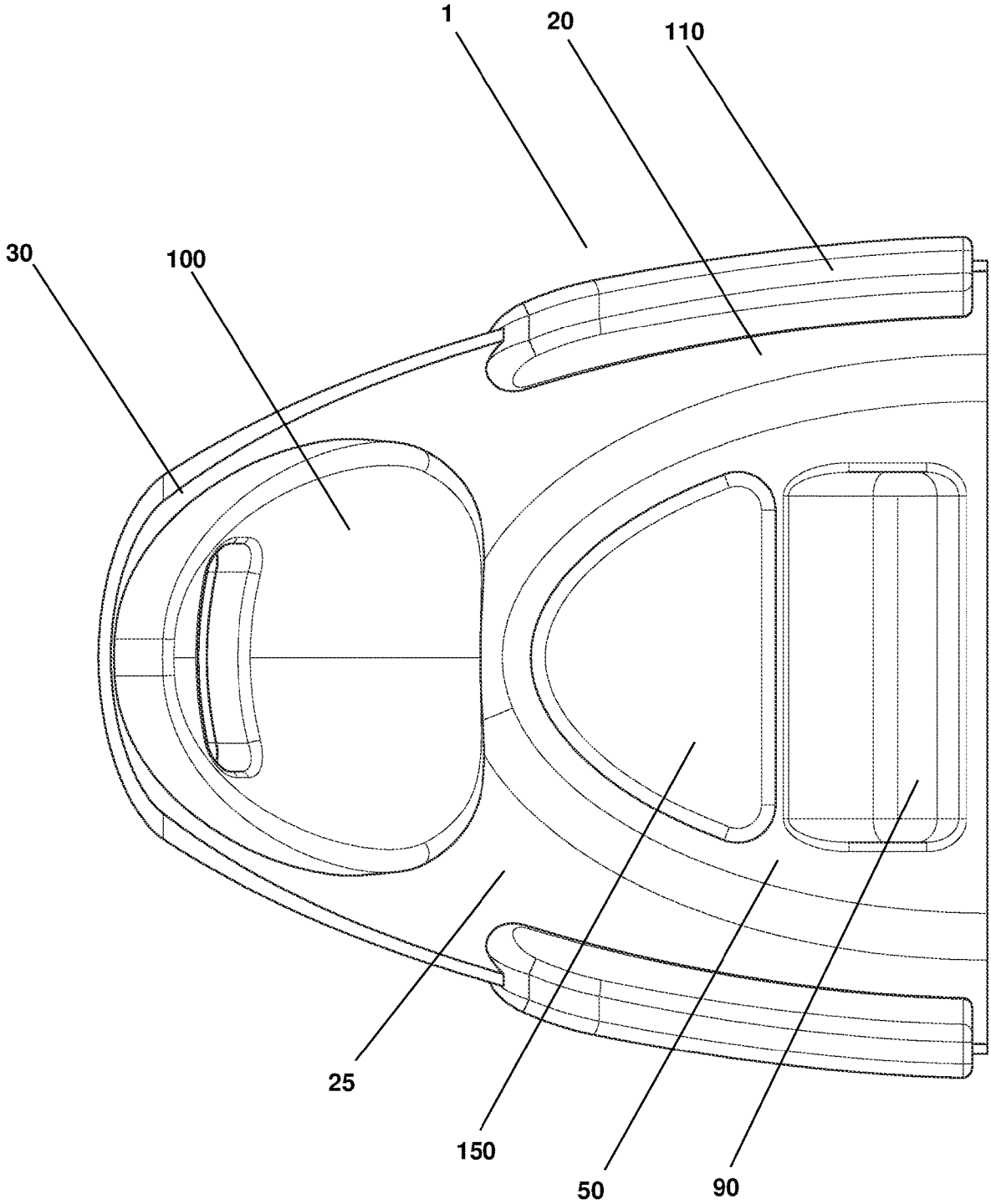
FIG. 15 shows a top plan view of the expanding bathtub of FIG. 1 in a detached configuration.
Figure 16:
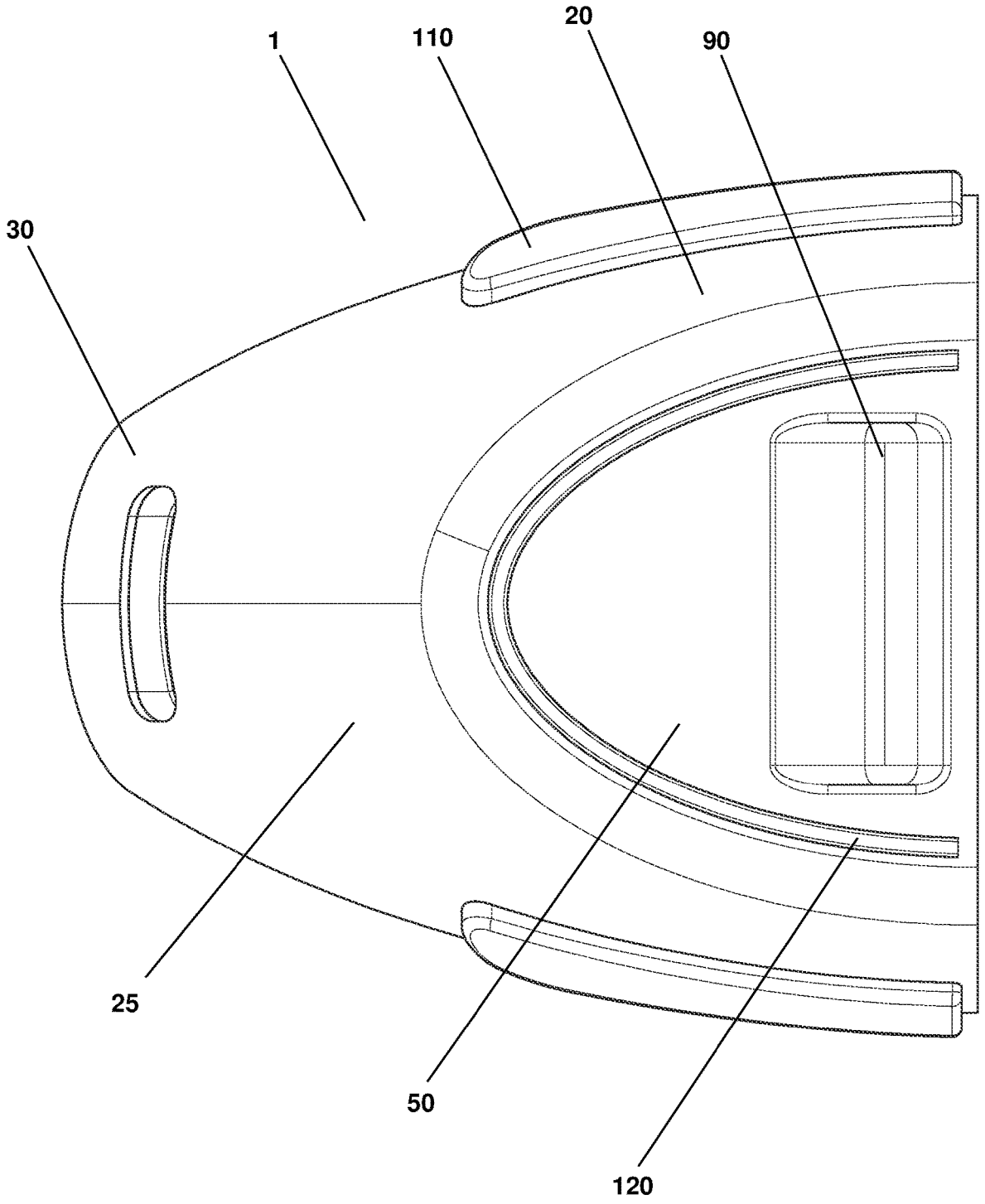
FIG. 16 shows a bottom plan view of the expanding bathtub of FIG. 1 in a detached configuration.
Figure 17:
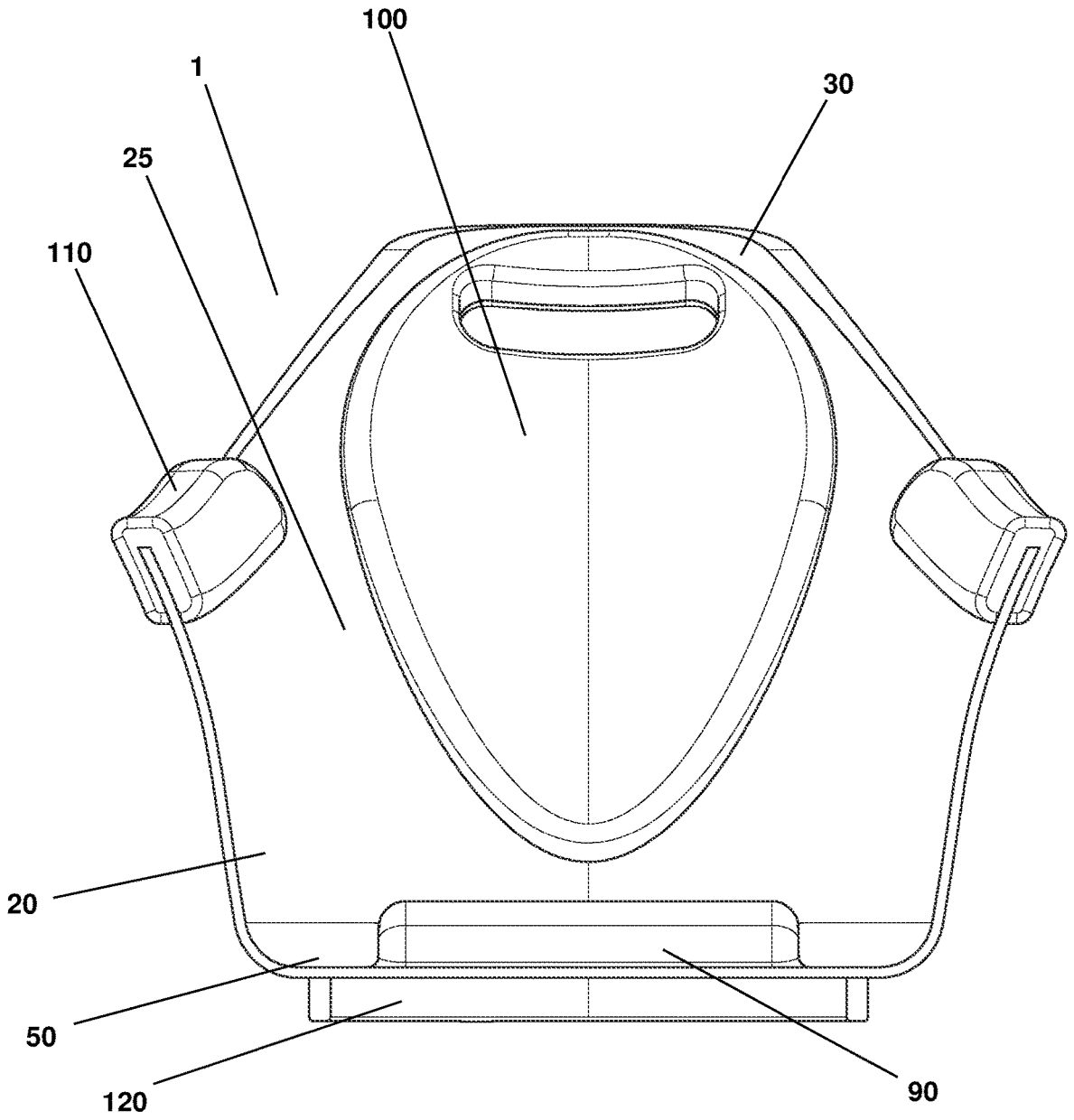
FIG. 17 shows a right side elevation view of the expanding bathtub of FIG. 1 in a detached configuration.
Figure 18:
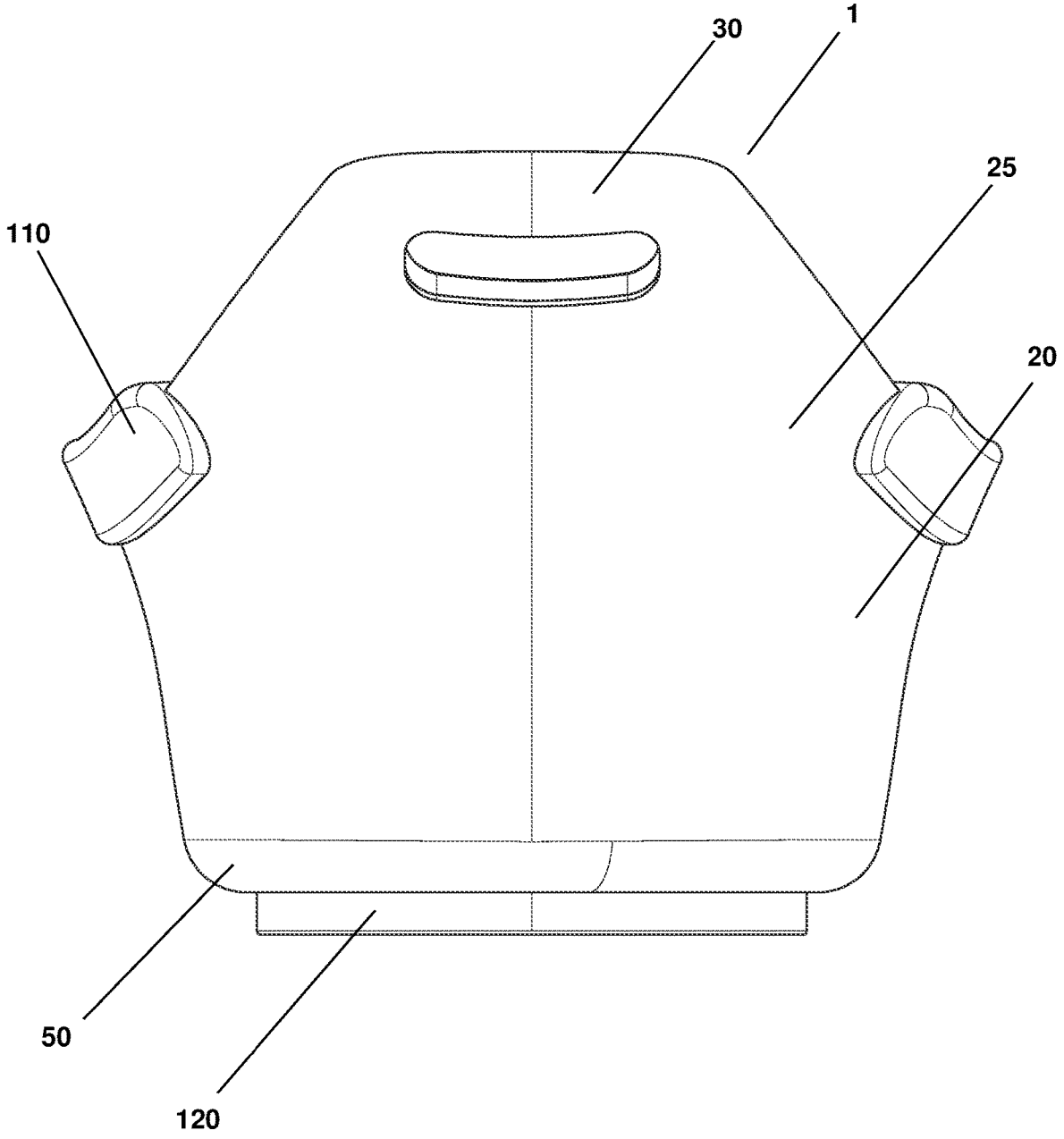
FIG. 18 shows a left side elevation view of the expanding bathtub of FIG. 1 in a detached configuration.

FIG. 15 shows a top plan view of the expanding bathtub of FIG. 1 in a detached configuration. FIG. 16 shows a bottom plan view of the expanding bathtub of FIG. 1 in a detached configuration. FIG. 17 shows a right side elevation view of the expanding bathtub of FIG. 1 in a detached configuration. FIG. 18 shows a left side elevation view of the expanding bathtub of FIG. 1 in a detached configuration.

The expandable bathtub 1 may further be detachable and reattachable at an edge between a perimeter of the base portion 50 and a lower edge of each respective side wall 20 and each respective end wall 30. The expandable bathtub 1 may further be detachable and reattachable at a vertical seam bisecting each respective end wall 30. The expandable bathtub 1 may further be detachable and reattachable at a seam bisecting each base portion 50 and the base accordion 40. The expandable bathtub 1 may further be detachable and reattachable at an edge between a perimeter of the base accordion 40 and a lower edge of each respective side accordion 10.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. An expanding bathtub comprising:

a base;

two end walls;

two side walls connected at either end to one of said two end walls;

an accordion structure within each of said two side walls comprising at least two configurations wherein in said first configuration each said accordion structure is collapsed and in said second configuration each said accordion structure expanded;

wherein said two side walls are water tight at said accordion structure in each of said first and said second configuration.

2. The expanding bathtub of claim 1, further comprising a plurality of portals on either side of said accordion structure of each respective wall of said two side walls.

3. The expanding bathtub of claim 2, wherein said portals of said plurality of portals are arranged in horizontal rows, each said horizontal row of said horizontal rows at different heights relative to one another.

4. The expanding bathtub of claim 2, wherein every portal of said portals are sealable with a plug and/or a slidable cover forming a water-tight seal.

5. The expanding bathtub of claim 1, wherein each said accordion structure is repeatedly removable and re-attachable by hand from at least one side of a respective side wall of said two side walls, creating a half tub open on one horizontal side when said accordion structure is removed therefrom.

6. The expanding bathtub of claim 1, wherein said accordion structures are expandable and collapsible in a horizontal direction.

7. The expanding bathtub of claim 5, further comprising a lower accordion structure forming a continuous and unitary piece with said accordion structure within each of said two side walls within said base of said bathtub, wherein said lower accordion structure is collapsed in said first configuration and said lower accordion structure is expanded in said second configuration;

wherein said base is water tight at said lower accordion structure in each of said first and said second configurations.

8. The expanding bathtub of claim 7, further comprising a pair of raised ridges within said base;

wherein each ridge is adjacent to a respective side of said lower accordion structure and parallel to said lower accordion structure.

9. The expanding bathtub of claim 7, further comprising a removably attachable seam between said base and said side walls and/or said end walls.

10. The expanding bathtub of claim 9, further comprising a removably attachable seam vertically bisecting each of said end walls.

11. The expanding bathtub of claim 10, wherein said lower accordion structure is removable, creating a seat comprising a side wall of said two side walls and a portion of said base.

12. The expanding bathtub of claim 1, further comprising at least one portal in said base.

13. The expanding bathtub of claim 12, wherein said at least one portal is sealable with a plug and/or a slidable cover.

14. An expanding bathtub comprising:

a base;

two end walls; and two side walls;

wherein each said two side walls comprises an accordion structure comprising at least two configurations, wherein said first configuration is with each said accordion structure collapsed and said second configuration is with each said accordion structure expanded.

15. The expanding bathtub of claim 14, wherein each said end wall comprises two symmetrical portions;

wherein each symmetrical portion is connected to an other symmetrical portion at a first end thereof and to a respective side of a respective side wall at a second end thereof.

16. The expanding bathtub of claim 15, wherein said base comprises:

two substantially identical side portions; and a middle portion;

wherein said middle portion comprises an accordion structure.

17. The expanding bathtub of claim 16, wherein said middle portion of said base comprises two symmetrical portions;

wherein each of a first end and a second end of each said symmetrical portion is parallel to a ridge of said accordion structure.

18. The expanding bathtub of claim 17, wherein each of said base, said portions of said base, said two end walls, said portions of said two end walls, and said two side walls is removably attachable to said other components.

19. A method of using said expanding bathtub of claim 18, comprising steps of:

removably detaching a symmetrical portion of a first end wall, a contiguous symmetrical portion of said middle portion of said base, and a contiguous symmetrical portion of a second end wall;

removably attaching said symmetrical portion of said first end wall, said contiguous symmetrical portion of said middle portion of said base, and said contiguous symmetrical portion of said second end wall;

removably detaching a first end wall, a contiguous side portion of said base, and said middle portion of said base; and removably attaching said first end wall, said contiguous side portion of said base, and said middle portion of said base.

20. A method of using said expanding bathtub of claim 14, comprising steps of:

expanding said expanding bathtub into an expanded configuration by way of applying force along a horizontal axis thereof in a first direction; and condensing said expanding bathtub into a condensed configuration by way of applying force along said horizontal axis in a second direction;

wherein said second direction is substantially opposite of said first direction.

* * * * *